US006086218A

United States Patent [19]

Robertson

[11] Patent Number: 6,086,218

[45] Date of Patent: Jul. 11, 2000

[54] PORTABLE FLASHING SIGNAL LIGHT

[75] Inventor: James R. Robertson, North Hollywood, Calif.

[73] Assignee: Cal June Inc., North Hollywood, Calif.

[21] Appl. No.: 09/177,878

[22] Filed: Oct. 23, 1998

[51] Int. Cl.[7] ..... F21L 7/00

[52] U.S. Cl. ..... 362/157; 362/158; 362/208; 362/362; 362/184; 340/815.73; 340/815.75

[58] Field of Search ..... 362/157, 158, 362/202, 208, 35, 362, 184; 340/815.66, 815.73, 815.75, 815.76

[56] References Cited

U.S. PATENT DOCUMENTS

| | | | |
|---|---|---|---|
| 3,764,799 | 10/1973 | Schulz | 240/24 |
| 4,104,615 | 8/1978 | Hunter | 340/84 |
| 4,254,405 | 3/1981 | Wenzlaff | 340/321 |
| 5,530,633 | 6/1996 | Yuen | 362/184 |

*Primary Examiner*—Cassandra Spyrou
*Assistant Examiner*—Mohammad Y. Sikder
*Attorney, Agent, or Firm*—John E. Wagner; Robert C. Smith

[57] ABSTRACT

A portable battery powered signal light includes a battery housing and batteries, a generally cylindrical lens having threads and a lamp in the lens, a flasher positioned between the lamp and the battery housing including electrical contacts, a day-night sensor connected to the flasher to permit operation of the flasher only when it senses darkness and a locking ring having threads mating with the threads on the lens and an internal flange overlapping flange on the battery housing so that when threads on the locking ring are tightened on the threads of the lens, the battery housing, flasher and lens are secured together and electrical connections are made across the flasher, the day-night sensor and the lamp.

18 Claims, 4 Drawing Sheets

Fig 1
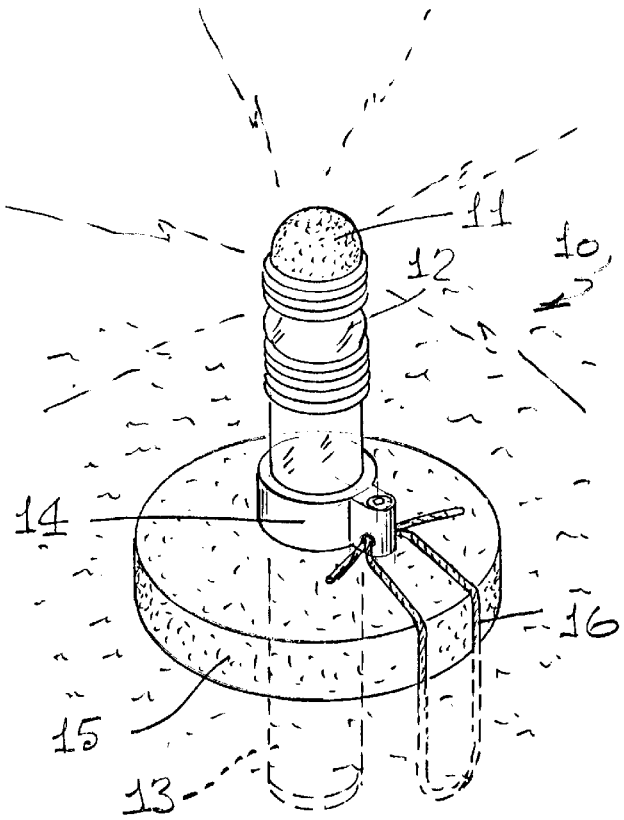
Fig 2
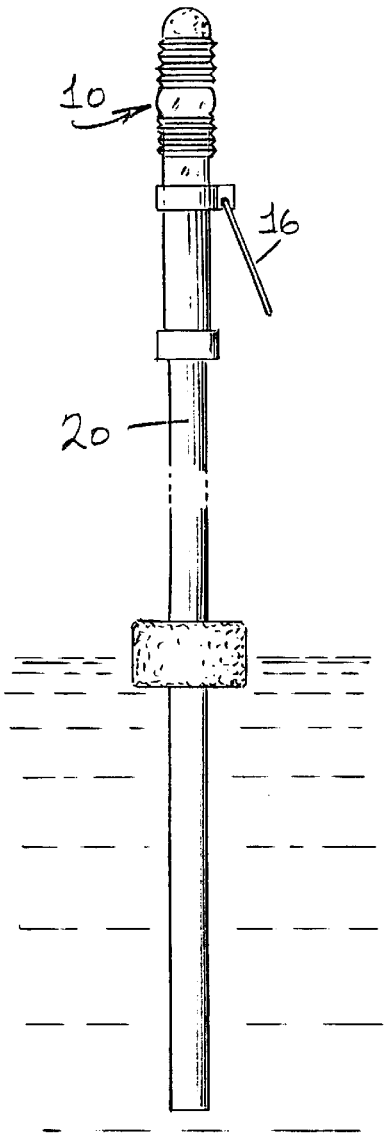
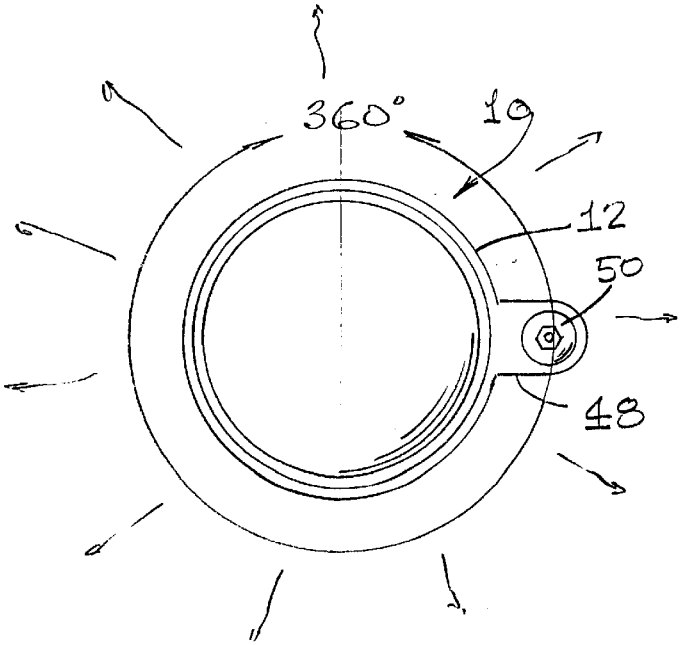
Fig 9
Fig 12
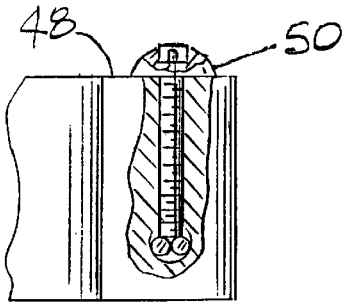

11
10
12
36
34
30
28
29
32
26
18
14
17
13
23
24
22
38
46

FIG 5
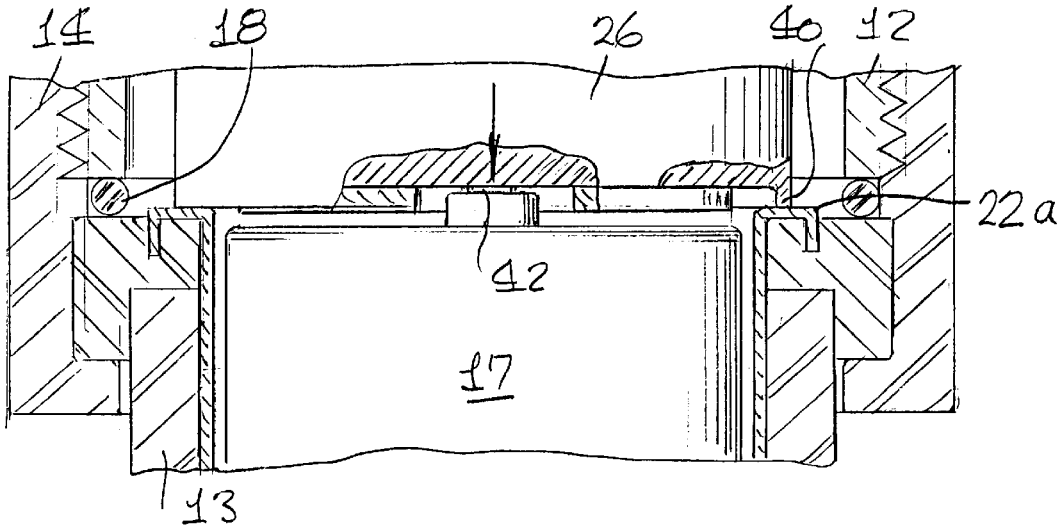
FIG 6
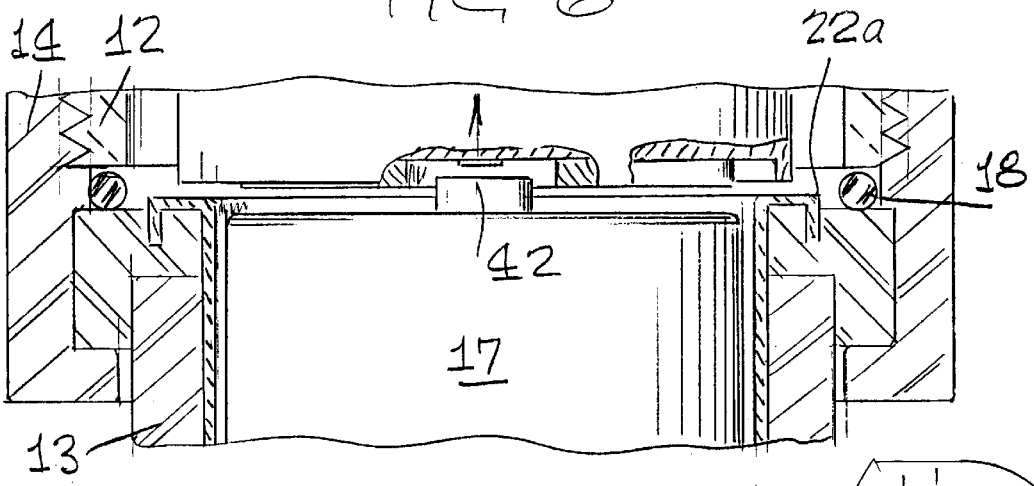
FIG 10
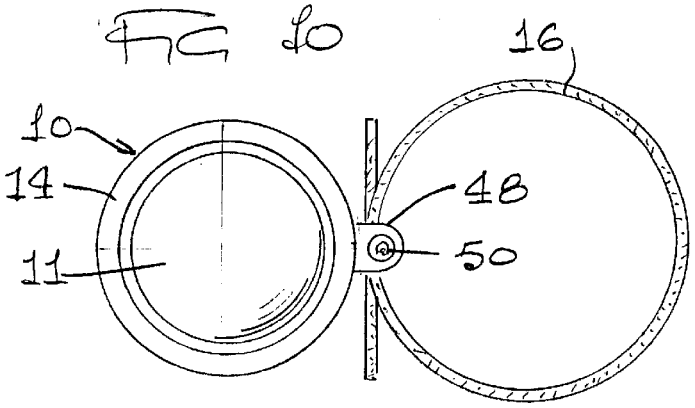
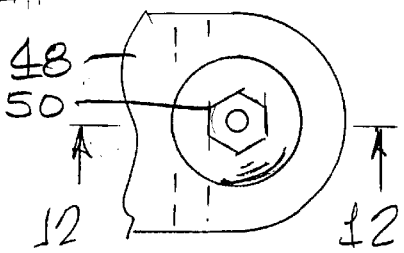
FIG 11

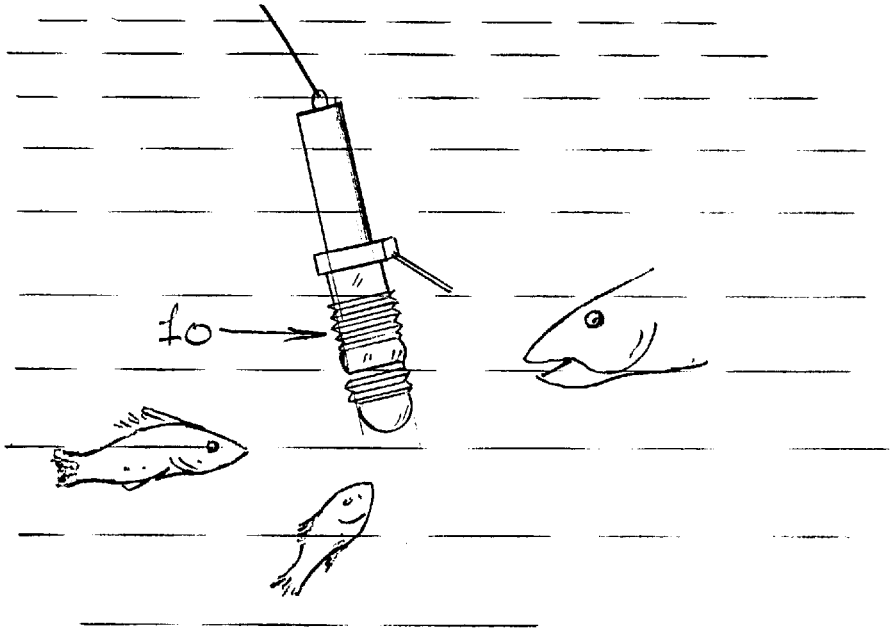
FIG 13
FIG 14
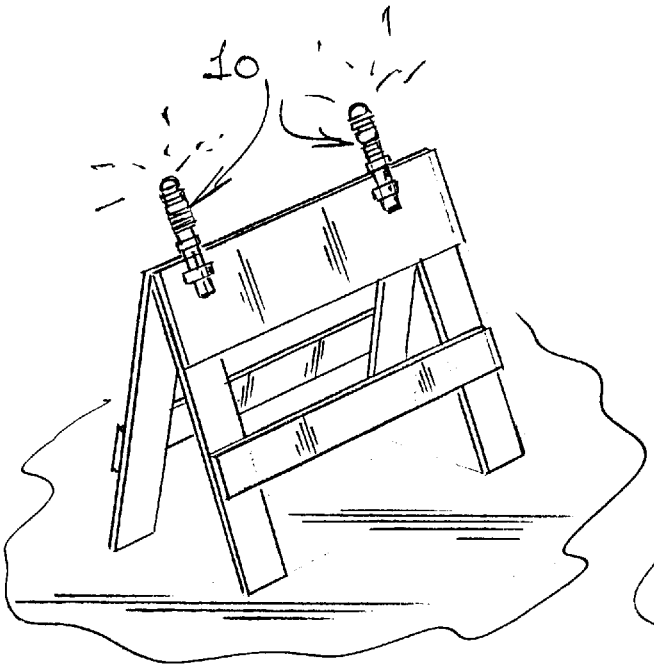
FIG 15
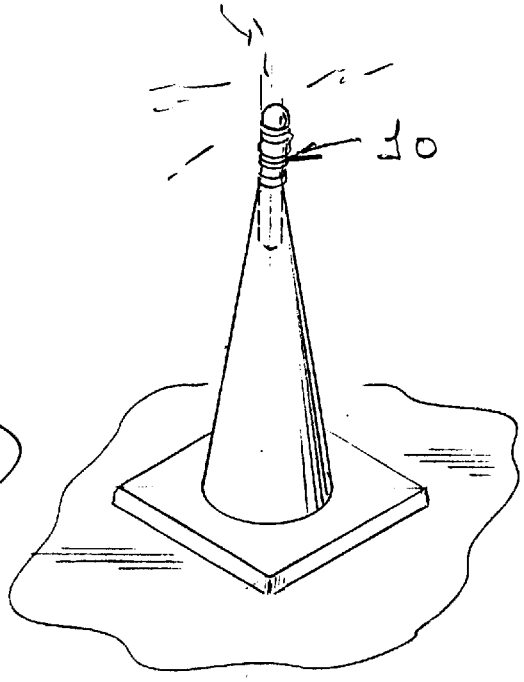

PORTABLE FLASHING SIGNAL LIGHT

BACKGROUND OF THE INVENTION

For years there has been a variety of flashing signal lights which are battery-powered and designed to meet particular needs. One example is the flashing signal light which is attached to life jackets to locate a person in a man overboard situation. Another type of flashing signal is used in road construction and repair where a barrier light provides a flashing warning signal for oncoming traffic to warn about a hazard. Flashing strobe signal lights are nearly universally installed permanently on aircraft to provide a brilliant flashing light warning to other aircraft.

I have found that many of these flashing signal lights are relatively expensive because of their need to fill specific requirements of an application and in many case cases such signal lights require specific certification or an expensive installation.

It appeared to me that an all-purpose battery-powered signaling light could be produced to provide a high intensity intermittent flashing signal over 360 degrees azimuth. The light should provide signaling for a period of time as long as one-year without battery or lamp replacement and with a high degree of reliability. It also needs to be waterproof so that such a signal light can be adapted to marine uses such as commercial or sport fishing needs as well as for any type of land based or other use. It is conceivable that such a lighting device could be of immeasurable value in locating lost hikers, hunters, or the like, who carry such a light and become the subject of search.

The signal light must be light in weight and small in size in order to be easily carried in a pocket or mounted on any floating device such as buoy or attached to a donut shaped float. The signal device likewise needs suitable attaching means such as a lanyard or a theft resistant cable where the device is expected to remain unattended for long periods of time.

It is important for the signaling device that a broad or full 360-degree azimuth beam of high intensity be provided. The use of particular lens configurations can be important to the provision of any particular requirement but I have found that a 360-degree fan shaped beam of intermittent white light is of the greatest universal use.

In order to achieve long service life without change of batteries, the signal light should have a low duty cycle flashing sequence, for example, 40 milliseconds flash, 30 flashes per minute. Where the signal is only required at night, a night sensor option is needed.

BRIEF DESCRIPTION OF THE INVENTION

I have accomplished all of the foregoing objectives in a battery-powered signaling device which is no larger than a conventional flashlight having two or three D cell batteries and which is sealed against water intrusion by appropriate means such as O-rings. A 360 degree lens is located near one end closing the battery housing and enclosing a support for one or more light sources located below an inverted conical reflector which enhances the beam emitted through the lens. A flasher unit is located within the battery housing below the one or more light sources and above the battery chamber. The flasher unit provides a low duty cycle intermittent flash with little drain on the batteries. A battery life of one year employing two D cell Ni-cad batteries is typical. A sealed internal ON/OFF switch is present to initiate and terminate operation and a day-night sensor photocell is contained within the housing acting to energize the light source only at night.

BRIEF DESCRIPTION OF THE DRAWINGS

This invention may be more clearly understood with the following detailed description and by reference to the drawings in which:

FIG. 1 is a perspective view of a flashing signal according to the invention shown supported by a floating collar;

FIG. 2 is a side elevational view of the flashing signal of FIG. 1 mounted on a floating staff;

FIG. 5 is a fragmentary sectional view, on an enlarged scale, of the signal light of FIG. 3 with the parts in position to energize the lamp;

FIG. 6 is a sectional view similar to FIG. 5 but showing the parts in a position wherein the lamp is de-energized;

FIG. 9 is a plan view of the signal light of FIG. 1 showing its radiation pattern;

FIG. 10 is a top plan view showing an attaching cable secured to a signal light of the invention;

FIG. 11 is an enlarged fragmentary view of a portion of FIG. 10;

FIG. 12 is a sectional view taken along line 12—12 of FIG. 11;

FIG. 13 is a side elevational view of the signal light of FIG. 1 suspended under the surface of a stream or lake as a flashing fish attracter;

FIGS. 14 and 15 are perspective views of the flashing signal light of this invention in road repair or construction applications on a traffic barrier in FIG. 14 and on a traffic cone in FIG. 15.

DETAILED DESCRIPTION OF THE INVENTION

Figures 3, 4, 7, 8:
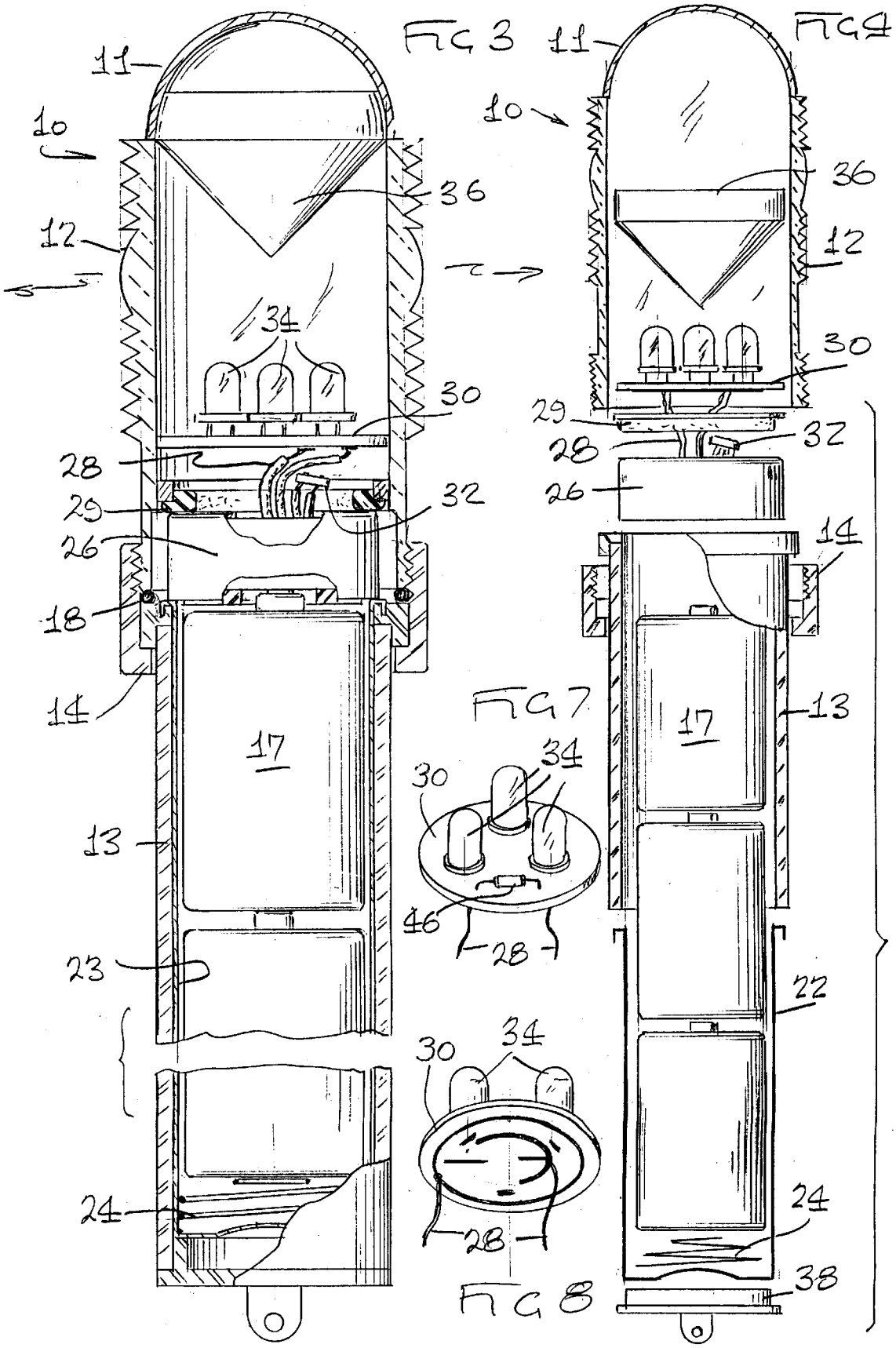
FIG. 3 is a longitudinal sectional view of the signal light of FIG. 1.
FIG. 4 is an exploded longitudinal sectional view of the assembly of FIGS. 1–3.
FIG. 7 is a perspective view of the multiple lamp assembly or module.
FIG. 8 is an underside perspective view of the lamp assembly of FIG. 5.

Now referring to FIG. 1 in connection with FIGS. 3 and 4, a flashing signal light, generally designated 10 is shown including a dome 11, a lens assembly 12 having a number of circumferential grooves, a battery housing 13 shown in dashed lines below the water level and a locking collar 14. The signal light is shown floating and supported by a flotation ring 15. A lanyard 16 which may be used for anchoring the signal light at a fixed location is shown extending under the water to a submerged anchoring device such as a lobster pot, but unshown in the drawing.

The signal light is positioned upright within a chamber in the lens assembly 12 above the water level and designed to produce a 360 degree fan beam as illustrated in FIGS. 1 and 2 with a typical vertical angle of about plus or minus 35 degrees in a vertical direction as is illustrated in FIGS. 2 and 3.

The signal lamp 10 is totally sealed from the intrusion of water whether floating or submerged up to 20 feet for extended periods. Sealing is accomplished by a single O-ring 18, appearing in FIG. 3, positioned between the lens assembly 12 and the battery housing 13.

The dome is preferably opaque and of a clearly visible color such as red.

Now referring to FIG. 2, a second form of mounting for this invention is illustrated. The same light assembly 10 is mounted on top of a floating spar 20 to be elevated above the water level and thereby increasing the range of the flashing light beam. The spar is supported on its own floatation ring and is suitably weighted to maintain the spar vertically. Typical applications for this use of the signal light of this invention are as either a land based or floating lighthouse for visibility of up to a mile at sea.

One of the advantages of this light for floating sea or harbor applications is that it need not be tended except for an annual inspection and change of batteries. In this case the lanyard 16 of FIG. 1 may be used or a theft resistant cable securing it to the spar may be preferred. The cable is preferably stainless steel and is secured by passing both ends through a projection on the locking collar 14 and both ends are locked in place by a special locking screw which may be best seen in FIGS. 11 and 12 as requiring a special driving tool for insertion or removal.

FIG. 3 is a longitudinal sectional view through light assembly 10. Within the battery housing 13 which may contain two or three connected D cell batteries 17 is an electrical conducting strip 22 which extends down opposite sides of the inside of battery housing 13 and across the end. A spiral spring 24 makes contact with strip 20 and with one of the D cells. At the upper end of housing 13, ends of strip 22 are bent over and secured to the housing. Located immediately above housing 13 is a flasher unit 26 which includes a metal cylindrical housing having an edge shown in contact with the bent over portions of strips 22. Conductors 28 from flasher unit 26 are connected through an annular seal 29 to a circuit board 30 and to a day-night sensor 32. Circuit board 30 carries a plurality of lamps 34 within a chamber in lens 12. Also carried within lens 12 and immediately below dome 11 is an inverted conical reflector 36 which deflects light from lamps 34 laterally in a 360° pattern.

FIG. 4 is an exploded view of the light assembly shown in FIG. 3. The dome 11 is shown attached to lens 12 and the reflector 36 is shown separated from the dome 11 and the lens 12. The flasher 26 is shown separated from the lens 12 and with wires 28 extending through seal 29 to circuit board 30. The day-night sensor 32 is shown connected to the flasher. In this view the conductor strip 22 is shown separated from housing 13 and from spring 24. An end cap 38 is shown separate from housing 13. Locking collar 14 is also shown separated from lens assembly 12 and from housing 13.

FIGS. 5 and 6 show fragmentary portions of FIG. 3 in enlarged scale to more clearly show describe the electrical switching functions of the light assembly 10. FIG. 5 shows the lens assembly 12 threadedly engaged with and securely clamped to the housing 13 by means of locking collar 14 with a conducting edge 40 of flasher 26 making contact with the bent over parts 22*a* of conductor strips 22. The positive terminal of a battery 17 is urged upwardly by spring 24 where it makes contact with a conducting terminal 42 centered at the bottom of flasher 26. From this it will be recognized that a circuit is closed when locking ring 14 is turned sufficiently to cause edge 40 to contact the bent over parts 22*a* of conductor strips 22. The circuit can still be open, however, if the day-night sensor 32, which is a light sensitive diode, senses light. In such case, it opens the connection to the flasher 26 and the lamps 34 will not be energized. When the day-night sensor 32 senses dark, it will close the circuit and lamps 34 will begin to flash. Since locking ring 14 is not a switch, as such, connections to the light assembly 10 can be tested by putting it in the dark.

FIG. 6 shows the same parts described above, but it will be observed that locking ring 14 has not been tightened to the extent that edge 40 of flasher 26 has made contact with the bent over parts 22*a* of conductor strips 22. Absent such contact, the circuit is open and lamps 34 will not flash, irrespective of the operation of the day-night sensor 32.

FIG. 7 is a perspective view showing circular mounting board 30 to which are secured a group of three lamps 34. FIG. 8 shows the same board as seen from the bottom including some of wires 28 which connect board 30 to the flasher. Conductor tracks are formed on the bottom of board 30 to carry current to each of lamps 34. Wires 28 may also be connected to one or more resistors 46 which may be required to limit current flow to lamps 34.

FIG. 9 is a top plan view of the signal light 10 showing light emanating from the lens 12 in a 3600 pattern. Molded with locking ring 14 is a projection 48 carrying a locking screw 50. FIG. 10 is a top plan view on a small scale of the signal light 10 with locking ring 14 and projection 48, and locking screw 50 securing a lanyard 16 to light 10. FIG. 11 is an enlarged fragmentary view of a portion of FIG. 9 showing projection 48 and locking screw 50. The dashed lines indicate a channel for receiving a lanyard. FIG. 12 is a sectional view taken along line 12—12 of FIG. 11. As indicated above, locking screw 50 is preferably a special screw requiring a special driving tool for installation or removal of the lanyard 16.

In addition to the use as a flashing light on a buoy as described in connection with FIG. 2, the seals are sufficiently secure that the signal light 10 may be submerged as shown in FIG. 13 as a means for attracting fish. Other applications for signal light 10 are shown in FIGS. 14 and 15. In FIG. 14, the signal light 10 is mounted on a barrier to warn of a construction zone or other hazard. In FIG. 15, light 10 is mounted on a traffic cone. Many other applications for the signal light will no doubt occur to the reader.

The above-described embodiments of the present invention are merely descriptive of its principles and are not to be considered limiting.

What is claimed is:

1. A portable flashing signal light comprising:

a battery housing;

battery means in said housing;

a lens having an inside chamber and means closing one end of said chamber;

a lamp in said chamber;

a flasher connected to said lamp;

a day-night sensor connected to said flasher;

means for securing said battery housing, said flasher and said lens together; said securing means being operative to connect said battery means to said flasher, said day-night sensor and said lamp for operation; and wherein said securing means comprises a locking ring having threads and a flange, said battery housing includes a flange overlapping said locking ring flange and said lens includes threads engaged with said locking ring threads.

2. A portable flashing signal light as claimed in claim 1 wherein said day-night sensor is a light responsive diode.

3. A portable flashing signal light as claimed in claim 1 wherein said flasher includes an electrical contact member, said housing includes a contact area adjacent said electrical contact member and wherein said securing means is movable to bring said electrical contact member into contact with said contact area while sealing said housing.

4. A portable flashing signal light as claimed in claim 1 wherein seal means are interposed between said battery housing and said lens.

5. A portable flashing signal light as claimed in claim 1 wherein said lens is a lenticular lens and is transparent over 360 degrees.

6. A portable flashing signal light as claimed in claim 1 wherein said battery means comprises a plurality of D cell batteries in series.

7. A portable battery powered signal light comprising:

a battery housing, a lens having an inside chamber, a lamp in said chamber, an inverted conical reflector in said chamber, a flasher connected to said lamp, seal means between said housing and said lens, means for clamping said battery housing, said flasher and said lens together; and electrical contact means for connecting a battery within said housing with said flasher whenever said clamping means secures said battery housing to said lens; and wherein said clamping means comprises a locking ring having threads and a flange, said battery housing includes a flange overlapping said locking ring flange and said lens includes threads engaged with said locking ring threads.

8. A portable flashing signal light as claimed in claim 7 further comprising electrical conducting means extending from a first end of said battery housing to a second end thereof including a contact area adjacent to said flasher.

9. A portable battery powered signal light as claimed in claim 8 further comprising batteries in said battery housing and wherein said clamping means connects said batteries into a circuit including said flasher and said lamp.

10. A portable flashing signal light as claimed in claim 8 wherein said flasher includes an electrical contact member, and said clamping means is movable to bring said electrical contact member into contact with said contact area.

11. A portable flashing signal light as claimed in claim 8 wherein a day-night sensor is connected to said flasher.

12. A portable flashing signal light as claimed in claim 11 wherein said day-night sensor is a light responsive diode.

13. A portable flashing signal light including a battery housing;

battery means in said housing;

a generally cylindrical lens;

a lamp in said lens;

an inverted conical reflector in said lens serving to reflect light from said lamp through said lens;

a flasher in said lens connected to said lamp and having an electrical contact;

a day-night sensor connected to said flasher;

electrical conducting means connected to said battery means and terminating in a contact area;

seal means between said housing and said lens;

clamping means for clamping said battery housing, said flasher and said lens together to connect said battery means to said flasher, said day night sensor and said lamp; and wherein said clamping means comprises a locking ring having threads and a flange, said battery housing includes a flange overlapping said locking ring flange and said lens includes threads engaged with said locking ring threads.

14. A portable flashing signal light as claimed in claim 13 wherein said day-night sensor is a light responsive diode.

15. A portable flashing signal light as claimed in claim 13 wherein said contact area is adjacent said electrical contact and said locking ring is rotatable to bring said electrical contact into contact with said contact area.

16. A portable flashing signal light as claimed in claim 13 wherein seal means are interposed between said flasher and said lens.

17. A portable flashing signal light as claimed in claim 15 wherein said locking ring includes a projection and means for securing a lanyard to said projection.

18. A portable flashing signal light comprising:

a battery housing;

battery means in said housing;

a lens having an inside chamber and means closing one end of said chamber;

an inverted conical reflector in said chamber;

a lamp in said chamber;

a flasher connected to said lamp;

a day-night sensor connected to said flasher;

means for securing said battery housing, said flasher and said lens together; said securing means being operative to connect said battery means to said flasher, said day-night sensor and said lamp for operation; and wherein said securing means comprises a locking ring having threads and a flange, said battery housing includes a flange overlapping said locking ring flange and said lens includes threads engaged with said locking ring threads.

* * * * *